United States Patent [19]

Jaffe

[11] Patent Number: 4,993,560

[45] Date of Patent: Feb. 19, 1991

[54] CARD HOLDER

[76] Inventor: Sidney Jaffe, 5200 Irvine Blvd., #199, Irvine, Calif. 92720

[21] Appl. No.: 371,627

[22] Filed: Jun. 26, 1989

[51] Int. Cl.[5] ..... A47F 5/00

[52] U.S. Cl. ..... 211/45; 211/113; 40/124; 40/124.4

[58] Field of Search ..... 211/113, 117, 118, 45; 40/124, 124.1, 124.2, 124.4

[56] References Cited

U.S. PATENT DOCUMENTS

| | | | |
|---|---|---|---|
| 1,006,334 | 10/1911 | Wright | 40/124.4 |
| 1,676,492 | 7/1928 | Goodwin | 40/124.4 |
| 1,850,362 | 3/1932 | Vogel | 40/124.4 |
| 2,916,843 | 12/1959 | Meyer | 40/124.4 X |
| 3,327,419 | 6/1967 | Stanos | 248/205.2 |
| 3,581,419 | 6/1971 | McCracken | 40/124 |
| 4,315,376 | 2/1982 | Eichenauer | 40/124.4 |
| 4,729,182 | 3/1988 | Sherman | 40/124 |

FOREIGN PATENT DOCUMENTS

| | | | |
|---|---|---|---|
| 2074855 | 11/1981 | United Kingdom | 40/124 |

*Primary Examiner*—Robert W. Gibson, Jr.
*Attorney, Agent, or Firm*—Irving Keschner

[57] ABSTRACT

A shaped card holder having a plurality of slots and adjacent protrusions formed therein to hold a plurality of cards. The card holder may have a shape, for example, corresponding to a symbol of a holiday, such as a Christmas tree. The card holder can be self-supporting or supported through an opening formed in the top portion of the card holder.

2 Claims, 1 Drawing Sheet

CARD HOLDER

BACKGROUND OF THE INVENTION

1. Field of the Invention

The present invention relates to an apparatus for holding cards.

2. Description of the Prior Art

A season, such as Christmas, is a time when people receive many holiday cards. What typically happens is that the card recipient either stores the cards in an area, such as a drawer, not visible to visitors to the recipient's home, or they are supported on a table, taped to a wall, or disposed in a trash container. Displaying the cards by either taping them to a surface, such as a wall, or supporting the cards on a table leaves much to be desired. For example, taping cards to a surface can cause the surface to become dirty or, in some cases, portions of the wall material can be removed after the card is lifted from the surface. In addition, the arrangement of cards on the wall or table surface is most likely not to be aesthetically pleasing. Further, the capacity of the wall or table surface may not be sufficient to hold all the cards received.

What is therefore desired is to provide a card holder which is aesthetically attractive and which is of a size sufficient to hold a plurality of cards. It is also desired that the card holder be relatively inexpensive yet sturdy enough to be reused.

SUMMARY OF THE INVENTION

The present invention provides a shaped card holder of sufficient size to allow a number of cards, to be supported at the same time. The card holder is fabricated from a flexible material, preferably corrugated board. A plurality of shaped slots are formed along the surface of the card holder, the shape of the slots and the holder material being such that the cards are supported securely therein. The cards can be removed from the slots for viewing and then replaced. The card holder can be supported through an opening formed on the top portion of the holder or can be self-supported by a base member.

Fabricating the card holder from corrugated board or similar materials enables the card holder to be durable and flexible and yet to be produced at a relatively inexpensive cost.

BRIEF DESCRIPTION OF THE DRAWING

For a better understanding of the invention as well as other objects and features thereof, reference is made to the following description which is to be read in conjunction with the accompanying drawing wherein.

DESCRIPTION OF THE INVENTION

Figure 1:
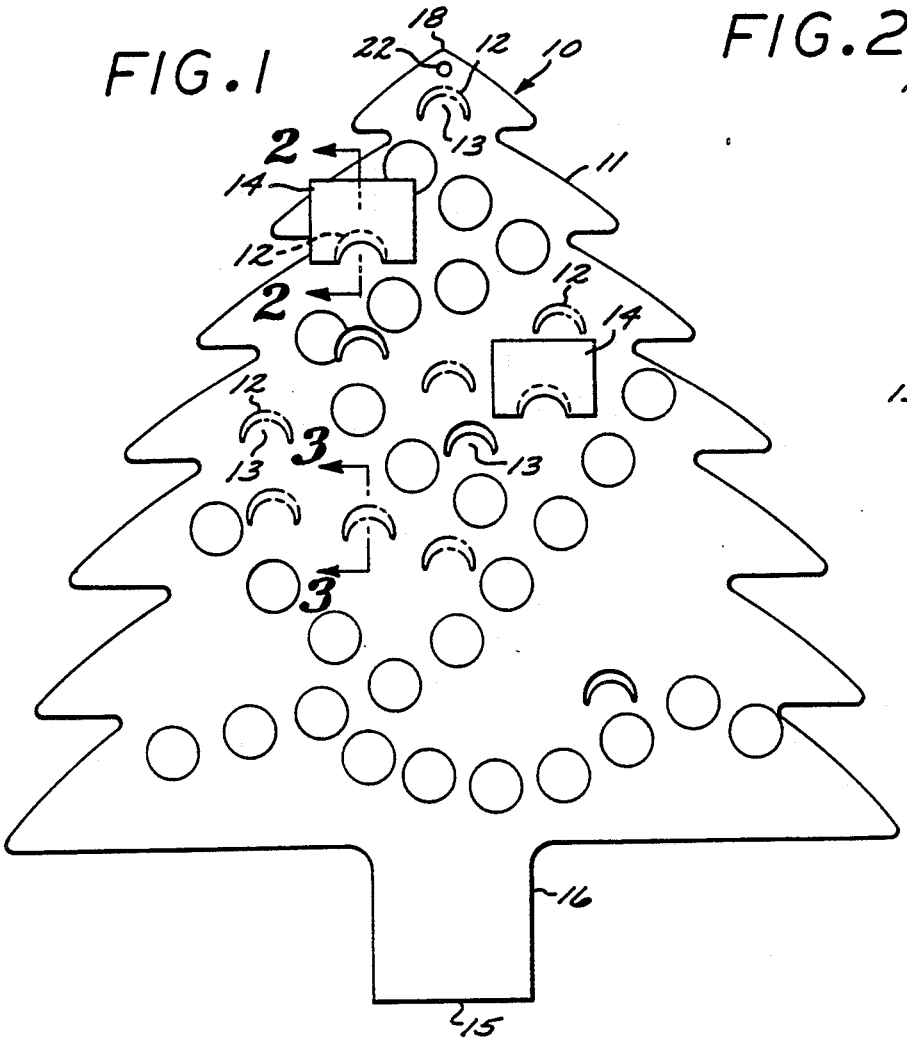
FIG. 1 is a plan view of the card holder of the present invention.
Figure 2:
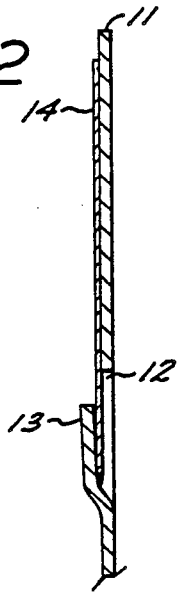
FIG. 2 is a sectional view along line 2—2 of FIG. 1.

Referring now to FIG. 1, a plan view of the shaped card holder 10 of the present invention is illustrated. Card holder 10 is fabricated from a flexible, strong and relatively inexpensive material 11, preferably corrugated board. Other flexible type materials, such as plastic, chipboard and plexiglas, can also be utilized. Card holder 10 is preferably shaped to correspond to a symbol of the particular holiday for which the card recipient has decided to display the cards. For example, during the Christmas season, the card holder 10 could be shaped like the Christmas tree shown in FIG. 1 and appropriately colored. A plurality of slots 12 are punched through card holder 10. Slots 12 can take various shapes such as, for example, rectangular, triangular, square or the curved shape as illustrated. It should be noted that when the slot is punched in material 11, correspondingly shaped protrusion 13 is simultaneously formed adjacent to the slot opening as illustrated. The nature of the material and the shape of the slots enables cards 14 to be securely held within their corresponding slots and yet allows the cards to be removed easily when somebody desires to read the message on the card. The slots 12 are of a size and shape to allow more than one card to be held therein if necessary.

Figure 4:
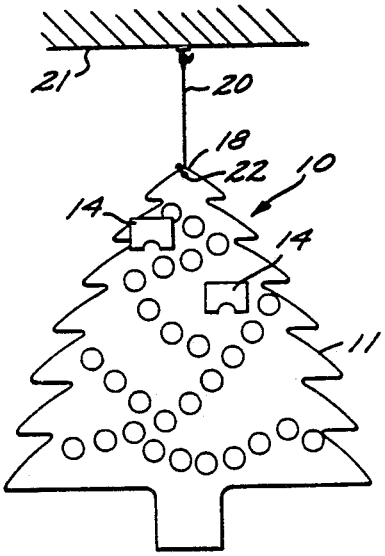
FIG. 4 is a view illustrating the card holder of the present invention supported from another member.

Card holder 10 is of a physical size such that many cards 14 could be held. For example, the distance between the bottom 15 of base 16 of the card holder 10 shown in FIG. 1 and the upper tip of the card holder 18 is approximately three feet. In this configuration, up to thirty cards can be held. For a 12 inch card holder size, up to eight cards can be held. A 24 inch card size can hold up to 15 cards. Obviously, the size of the card holder determines the number of cards which can be held. As shown in FIG. 4, the card holder 10 is supported by a cord 20 extending from the ceiling 21, for example, and which passes through a hole 22 formed at the top portion of the card holder 10.

Figure 3:
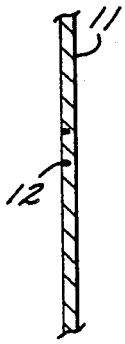
FIG. 3 is a sectional view along line 3—3 of FIG. 1.

FIG. 3 is a cross-sectional view showing in more detail how a card 14 is supported between the slot opening and protrusion 13. In particular, when a card 14 is to be supported in card holder 10, the card is forced towards the slot opening, a space between protrusion 13 and a rear support wall formed by material 11 being created to allow the card 14 to be inserted therein and held between protrusion 13 and the rear support wall. The material 11 is flexible enough such that the protrusion is movable away form the rear wall as the card is forced towards the slot opening.

FIG. 4 illustrates a pre-formed slot in material 11 prior to it being punched through to form the actual slot 12.

Figure 5:
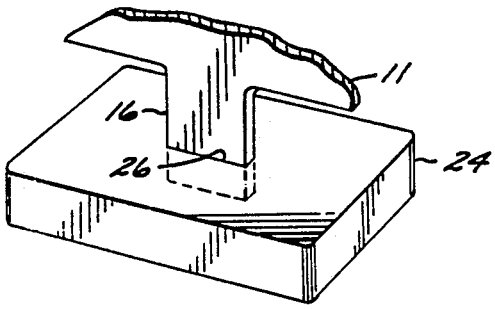
FIG. 5 illustrates a base member which can self-support the card holder shown in FIG. 1.

FIG. 5 shows an alternative mode for supporting the card holder 10. In particular, the card holder 10 is illustrated as being supported solely by a base member 24, a portion of base 16 of holder 10 extending into a slot 26 formed in base member 24. Base member 24 can be formed in shapes other than the rectangular shape shown in the figure.

The present invention thus provides an inexpensive card holder which is of sufficient size to securely support a plurality of cards or other objects. The card holder itself can take various shapes, such as corresponding to a symbol associated with the occasion for which the cards were sent to the recipient. The card holder is supported through an opening therein or mounted on a base member so that it is self-supporting, at the option of the user. The card holder is fabricated from a strong, resilient and relatively inexpensive material such as corrugated board. The resiliency of the material allows the card holder to be folded and stored in a small space.

While the invention has been described with reference to its preferred embodiment, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. A card holder comprising a flexible member having a plurality of slots formed therein, a plurality of shaped members adjacent corresponding ones of said slots forming support walls to secure cards inserted between said shaped members and said adjacent slots; means provided at the top portion of said holder to enable said holder to be suspended from a support surface; a base member, separate from said flexible member, having a slot formed therein; and means at the bottom portion of said card holder adapted for insertion into the slot formed in said base member to enable the card holder to be self supporting.

2. The card holder defined in claim 1 wherein said card holder is in the form of a Christmas tree.

* * * * *